US008875342B2

(12) United States Patent
Conrad

(10) Patent No.: US 8,875,342 B2
(45) Date of Patent: Nov. 4, 2014

(54) BLEED AIR VALVE OF A SURFACE CLEANING APPARATUS

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 870 days.

(21) Appl. No.: 13/039,053

(22) Filed: Mar. 2, 2011

(65) Prior Publication Data

US 2011/0219575 A1 Sep. 15, 2011

Related U.S. Application Data

(63) Continuation-in-part of application No. 12/722,721, filed on Mar. 12, 2010, now abandoned.

(51) Int. Cl.

| | |
|---|---|
| ***A47L 9/16*** | (2006.01) |
| ***A47L 5/22*** | (2006.01) |
| ***A47L 9/00*** | (2006.01) |
| ***A47L 9/19*** | (2006.01) |

(52) U.S. Cl.

CPC . *A47L 9/16* (2013.01); *A47L 5/225* (2013.01); *A47L 9/0072* (2013.01); *A47L 9/19* (2013.01)

USPC ..... 15/347; 15/353

(58) Field of Classification Search

CPC ..... A47L 9/20; A47L 9/1658; A47L 9/1666; A47L 9/0072

USPC ..... 15/353, 347; 55/310, 311; 96/403

See application file for complete search history.

(56) References Cited

U.S. PATENT DOCUMENTS

| | | | | |
|---|---|---|---|---|
| 2,503,568 | A * | 4/1950 | Timm | 55/300 |
| 5,078,761 | A | 1/1992 | Dyson | |
| 6,167,588 | B1 * | 1/2001 | Dyson | 15/339 |
| 6,231,649 | B1 | 5/2001 | Dyson et al. | |
| 6,349,738 | B2 | 2/2002 | Dyson et al. | |
| 7,478,456 | B2 * | 1/2009 | Barker et al. | 15/323 |
| 8,142,554 | B2 * | 3/2012 | Eckstein et al. | 95/280 |
| 2001/0029845 | A1 * | 10/2001 | Dyson et al. | 96/403 |
| 2005/0028317 | A1 * | 2/2005 | Barker et al. | 15/323 |
| 2005/0251953 | A1 * | 11/2005 | Hackwell et al. | 15/387 |
| 2006/0156504 | A1 * | 7/2006 | Bruneau | 15/314 |
| 2007/0067945 | A1 * | 3/2007 | Kasper et al. | 15/353 |

(Continued)

FOREIGN PATENT DOCUMENTS

| | | | |
|---|---|---|---|
| GB | 2372431 | A * | 8/2002 |
| GB | 2394651 | A * | 5/2004 |
| WO | 2009/026709 | A1 | 3/2009 |

*Primary Examiner* — Joseph J Hail
*Assistant Examiner* — Joel Crandall
(74) *Attorney, Agent, or Firm* — Philip C. Mendes da Costa; Bereskin & Parr LLP/S.E.N.C.R.L., s.r.l.

(57) ABSTRACT

A surface cleaning apparatus comprises an air flow passage extending from a dirty air inlet to a clean air outlet. The surface cleaning apparatus further comprises a cyclone comprising a cyclone air outlet and positioned in the air flow passage downstream of the dirty air inlet. A suction motor is provided in the air flow passage downstream of the cyclone. A pre-motor filter is upstream of the suction motor and downstream of the cyclone. The pre-motor filter has an upstream side and a downstream side. The surface cleaning apparatus further comprises a bleed valve having an air inlet and an air outlet. The air outlet is positioned between the suction motor and the downstream side of the pre-motor filter and facing the downstream side of the pre-motor filter.

41 Claims, 10 Drawing Sheets

(56) References Cited

U.S. PATENT DOCUMENTS

2007/0209148 A1* 9/2007 Yacobi et al. ..... 15/352
2008/0047091 A1* 2/2008 Nguyen ..... 15/300.1
2008/0104793 A1* 5/2008 Kang et al. ..... 15/327.5
2008/0230446 A1* 9/2008 Bertram et al. ..... 209/10
2008/0263813 A1* 10/2008 Han et al. ..... 15/334
2009/0183337 A1* 7/2009 Davis ..... 15/347

* cited by examiner

BLEED AIR VALVE OF A SURFACE CLEANING APPARATUS

RELATED APPLICATIONS

This application is a continuation in part of co-pending U.S. patent application Ser. No. 12/722,721, filed Mar. 12, 2010, the entirety of which is incorporated herein by reference.

FIELD

The disclosure relates to surface cleaning apparatuses, such as vacuum cleaners. Particularly, the disclosure relates to bleed valves for surface cleaning apparatuses.

INTRODUCTION

The following is not an admission that anything discussed below is prior art or part of the common general knowledge of persons skilled in the art.

Various constructions for surface cleaning apparatus such as vacuum cleaners are known. Currently, many surface cleaning apparatus are constructed using at least one cyclonic cleaning stage. The air is drawn into the vacuum cleaner through a dirty air inlet and conveyed to a cyclone inlet. The rotation of the air in the cyclone results in some of the particulate matter in the airflow stream being disentrained from the airflow stream. This material is then collected in a dirt collection chamber, which may be at the bottom of the cyclone or in a dirt collection chamber exterior to the cyclone chamber (see for example WO2009/026709 and U.S. Pat. No. 5,078,761). One or more additional cyclonic cleaning stages and/or filters may be positioned downstream from the cyclone.

SUMMARY

The following summary is provided to introduce the reader to the more detailed discussion to follow. The summary is not intended to limit or define the claims.

According to one aspect, a surface cleaning apparatus has a bleed air valve wherein the bleed air valve has an outlet that provides bleed air as required to the downstream side of a pre-motor filter.

Optionally, the bleed air preferably travels through the bleed valve mechanism in a direction that is generally parallel to and optionally parallel to and in the same direction, as the direction of air flow exiting a cyclone. Alternately, or in addition, the bleed air preferably travels through the bleed valve mechanism in a direction that is generally parallel to and optionally parallel to and in the same direction, as the direction of air entering the suction motor. Alternatively, the bleed valve may extend in a transverse direction with respect to as the direction of air flow exiting a cyclone and/or the direction of air entering the suction motor and the bleed air can exit the bleed valve in a direction that is generally orthogonal to either the direction of air flow exiting the cyclone, the direction of air flow entering the suction motor, or both.

The pre-motor filter may be separated from the air inlet of the suction motor using support members such as ribs. The supporting ribs may therefore provide an open volume between the pre-motor filter and the suction motor inlet. The open volume may function as a plenum or header to permit the bleed air to travel from the bleed valve outlet to the suction motor air inlet. One or more cut outs or gaps maybe provided in some or all of the ribs to provide or enlarge then air flow path from the bleed valve outlet to the suction motor inlet, which air flow path is between the pre-motor filter and the suction motor. Accordingly, bleed air need not pass through the pre-motor filter to get to the suction motor air inlet.

An advantage of this configuration is that the bleed air is delivered directly to the suction motor. If the pre-motor filter is dirty or clogged, which may be the reason the bleed valve opens, then the flow of bleed air to the suction motor will not be impeded by the pre-motor filter.

Another advantage is that the configuration permits a more compact construction of the surface cleaning apparatus. This permits the weight of the surface cleaning apparatus to be reduced and increases the portability of the surface cleaning apparatus for the elderly or the infirm.

Another advantage is that the configuration permits the bleed valve air flow passage to be integrally molded with the suction motor housing of the surface cleaning apparatus. This permits fewer seals to be used in the manufacturing process and reduces the likelihood that air will leak into the motor through the bleed valve and reduce the air flow at the dirty air inlet.

In accordance with this aspect, a surface cleaning apparatus is provided. The surface cleaning apparatus comprises an air flow passage extending from a dirty air inlet to a clean air outlet. The surface cleaning apparatus further comprises a cyclone comprising a cyclone air outlet and positioned in the air flow passage downstream of the dirty air inlet. A suction motor is provided in the air flow passage downstream of the cyclone. A pre-motor filter is upstream of the suction motor and downstream of the cyclone. The pre-motor filter has an upstream side and a downstream side. The surface cleaning apparatus further comprises a bleed valve having an air inlet and an air outlet. The air outlet is positioned between the suction motor and the downstream side of the pre-motor filter and facing the downstream side of the pre-motor filter.

The cyclone may have a longitudinal axis, the bleed valve may comprise an airflow passageway having a longitudinal axis, and the longitudinal axes may be parallel. The air outlet of the bleed valve may face the cyclone air outlet.

The bleed valve may be integrally formed with a suction motor housing. The air inlet of the bleed valve may be provided in a sidewall of the suction motor housing. The bleed valve may be provided in a suction motor housing and may have a longitudinally extending passageway that is aligned with a longitudinal axis of the suction motor.

The air inlet of the bleed valve may be at an angle to the longitudinally extending passageway of the bleed valve.

The pre-motor filter may be removable and the air outlet of the bleed valve may be visible when the pre-motor filter is removed.

The bleed valve may have a longitudinally extending passageway that is aligned with a longitudinal axis of the suction motor and a direction of flow through the pre-motor filter.

The surface cleaning apparatus may further comprise an openable door and the bleed valve may be provided in the openable door. The openable door may provide access to at least one of the pre-motor filter and a dirt collection chamber of the cyclone.

The bleed valve may extend through the pre-motor filter.

According to another aspect, another surface cleaning apparatus is provided. The surface cleaning apparatus comprises an air flow passage extending from a dirty air inlet to a clean air outlet. A filtration member is positioned in the air flow passage downstream of the dirty air inlet. A suction motor is provided in the fluid flow path downstream of the filtration member. A pre-motor filter is upstream of the suction motor and downstream of the filtration member. The pre-motor filter has an upstream side and a downstream side. The surface cleaning apparatus further comprises a bleed valve having an air inlet and an air outlet. The air outlet is positioned between the suction motor and the downstream side of the pre-motor filter.

The filtration member may have a filtration member air outlet extending along a longitudinal axis, the bleed valve may comprise an airflow passageway having a longitudinal axis, and the longitudinal axes may be parallel.

The filtration member may comprise a cyclone having a cyclone air outlet and the bleed valve outlet may face towards the cyclone air outlet. The air outlet of the bleed valve may face the downstream side of the pre-motor filter.

The bleed valve may be integrally formed with a suction motor housing. The air inlet of the bleed valve may be provided in a sidewall of the suction motor housing. The bleed valve may be provided in a suction motor housing and may have a longitudinally extending passageway that is aligned with a longitudinal axis of the suction motor.

The air inlet of the bleed valve may be at an angle to the longitudinally extending passageway of the bleed valve.

The pre-motor filter may be removable and the air outlet of the bleed valve may be visible when the pre-motor filter is removed.

The bleed valve may have a longitudinally extending passageway that is aligned with a longitudinal axis of the suction motor and a direction of air flow through the pre-motor filter.

The surface cleaning apparatus may further comprise an openable door and the bleed valve may be provided in the openable door. The openable door may provide access to at least one of the pre-motor filter and a dirt collection chamber.

The filtration member may comprise a cyclone and the pre-motor filter may comprise foam.

The bleed valve may extend through the pre-motor filter.

The filtration member may comprise a cyclone having a cyclone air outlet that has an outlet on the upstream side of the pre-motor filter, the surface cleaning apparatus may further comprise an openable door, and the bleed valve may be provided in the openable door and may extend through the pre-motor filter.

The cyclone outlet may extend through the pre-motor filter.

The pre-motor filter may rest on a plurality of support members (e.g., ribs, support posts and the like) whereby the pre-motor filter is spaced from an inlet of the suction motor and a bleed air flow path is provided between the downstream side of the pre-motor filter and the inlet of the suction motor.

At least some of the support members are preferably configured such that air entering the bleed air flow path through the bleed valve travels other than radially inwards towards the inlet of the suction motor. For example, if the support members are ribs having gaps provided therebetween, bleed air flow travelling from the bleed valve air outlet to the suction motor may pass laterally through gaps and thereby be distributed over a larger volume.

The support members may be provided on a housing for the suction motor.

DRAWINGS

Reference is made in the detailed description to the accompanying drawings, in which.

DETAILED DESCRIPTION

Figure 1:
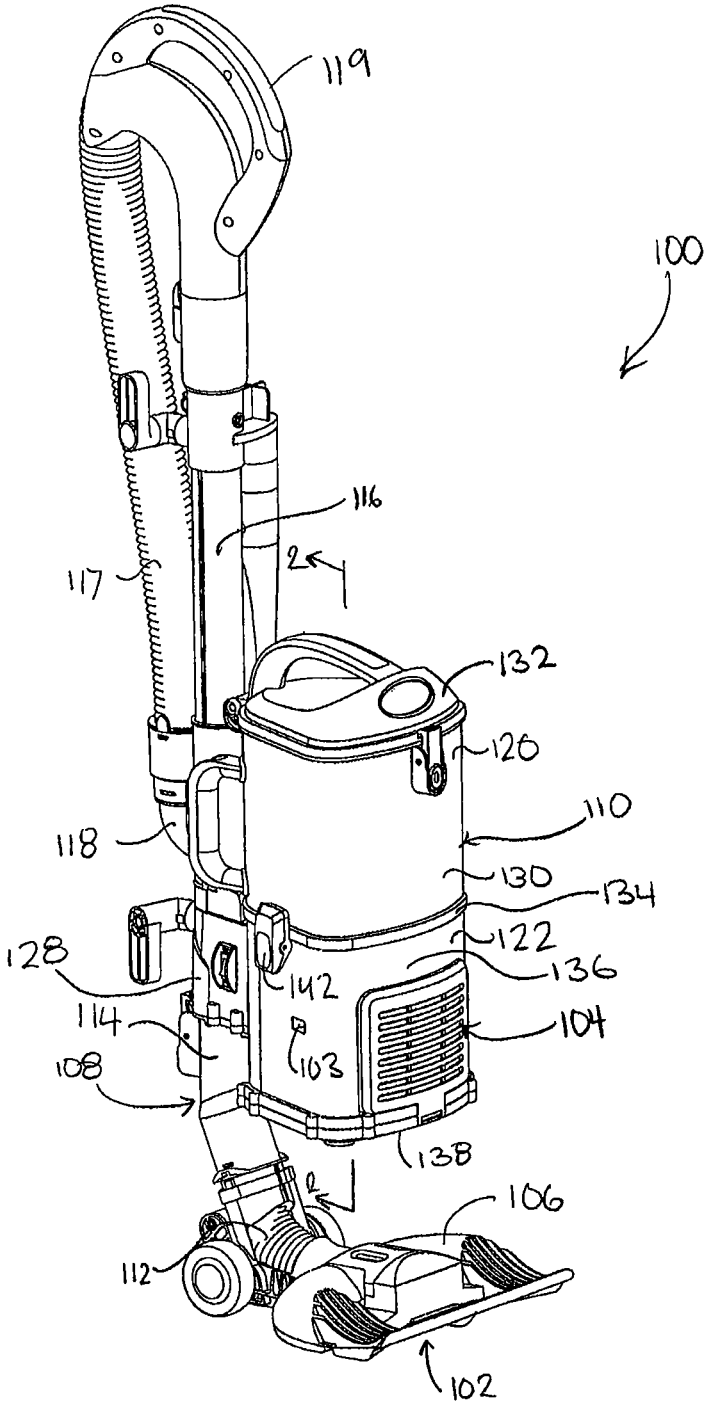
FIG. 1 is a perspective illustration of an embodiment of a surface cleaning apparatus.

Referring to FIG. 1, a first embodiment of a surface cleaning apparatus 100 is shown. In the embodiment shown, the surface cleaning apparatus 100 is an upright vacuum cleaner. In alternate embodiments, the surface cleaning apparatus may be another suitable type of surface cleaning apparatus, such as a canister type vacuum cleaner, and hand vacuum cleaner (see for example FIG. 5), a stick vac, a wet-dry type vacuum cleaner or a carpet extractor.

Referring still to FIG. 1, the surface cleaning apparatus 100 has a dirty air inlet 102, a clean air outlet 104, and an air flow passage extending therebetween. In the embodiment shown, the dirty air inlet 102 is provided in a lower surface of a surface cleaning head 106. From the dirty air inlet 102, the airflow passage extends through the surface cleaning head 106, and through an air conduit 108, to a suction and filtration unit 110. The clean air outlet 104 is provided in the suction and filtration unit 110. In the embodiment shown, the air conduit 108 includes a pivoting joint member 112 connected to the surface cleaning head 106, a lower upflow duct 114, an upper upflow duct 116, a hose 117, and an elbow joint 118. The elbow joint 118 is in airflow communication with the suction and filtration unit 110. In alternate embodiments, the air conduit 108 may be of another configuration. For example, only a pivoting joint member 112 and a lower upflow duct 114 may be provided.

A handle 119 is optionally mounted to the upper upflow duct 116, for manipulating the surface cleaning apparatus 100.

Figure 2:
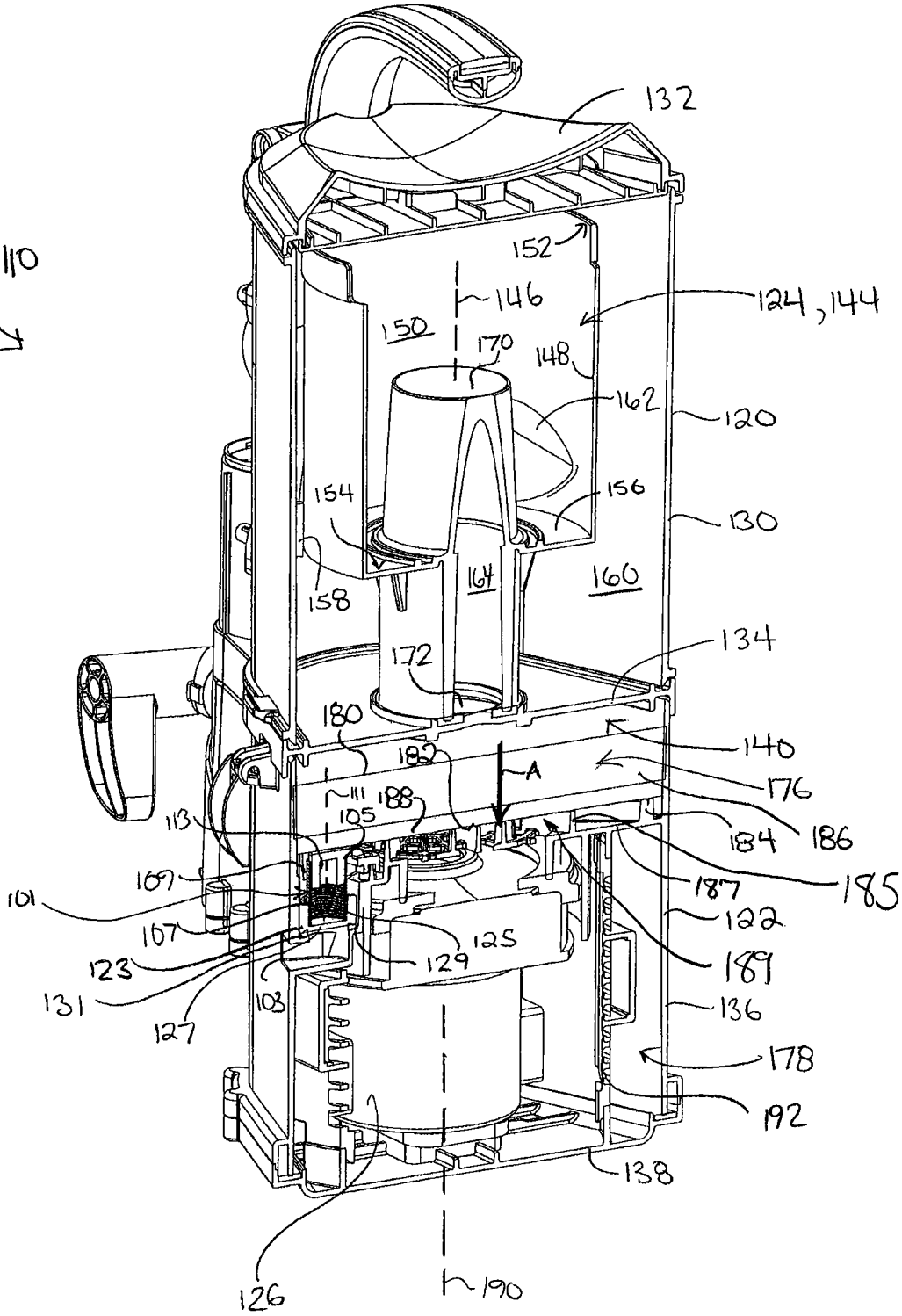
FIG. 2 is a cross section taken along line 2-2 in FIG. 1.

Referring now to FIG. 2, the suction and filtration unit 110 includes a filtration member housing 120, and a suction motor housing 122. The filtration member housing 122 houses filtration member 124, which is positioned in the airflow passage downstream of the dirty air inlet 102 for removing particulate matter from air flowing through the airflow passage. The suction motor housing 122 houses a suction motor 126, which is provided in the airflow passage downstream of the filtration member 124 for drawing air through the airflow passage.

In the embodiment shown, the suction and filtration unit 110 is supported by and mounted to the lower upflow duct 114. Particularly, a mount 128 is provided which mounts the suction and filtration unit 110 to the lower upflow duct 114. The mount 128 may be of any suitable configuration. In the embodiment shown, the mount 128 is integrally formed with the suction motor housing 122, and is mountable to the lower upflow duct 114. The mount 128 may be mountable to the lower upflow duct 114 in any suitable manner, and is preferably removably mountable to the lower upflow duct 114.

In the embodiment shown, the filtration member housing 120 includes a sidewall 130, a top wall 132, and a bottom wall 134. The suction motor housing 122 includes a sidewall 136 and a bottom wall 138, and an open top 140. The sidewall 136 of the suction motor housing 122 is removably mounted to the bottom wall 134 of the filtration member housing 120, so that the bottom wall 134 of the filtration member housing 120 seals the open top 140 of the suction motor housing 122. The sidewall 136 of the suction motor housing 122 may be removably mounted to the bottom wall 134 of the filtration member housing 120 in any suitable manner, such as by one or more latch members 142.

In the embodiment shown, as the suction motor housing 122 is mounted to the lower upflow duct 114, and the filtration member housing 120 is removably mounted to the suction motor housing 122 above the suction motor housing 122, the filtration member housing 120 may be removed from the suction motor housing by unlatching the one or more latch members 142, and lifting the filtration member housing 120 off of the suction motor housing 122. When this is done, the filtration member housing 120 will be generally sealed, except for any airflow passages leading to or from the filtration member housing 120, and the top 140 of the suction motor housing 122 will be open.

Referring still to FIG. 2, in the embodiment shown, the filtration member 124 is a cyclone 144. In alternate embodiments, the filtration member 124 may be, for example, a filter, such as a filter bag or a foam filter. In further alternate embodiments, the filtration member 124 may include a plurality of cyclones, or a plurality of cyclonic stages.

The cyclone 144 may be of any suitable configuration. In the embodiment shown, the cyclone 144 extends along a longitudinal axis 146, which is generally vertically extending, and includes a generally cylindrical cyclone wall 148, which defines a cyclone chamber 150. The upper end 152 of the cyclone wall 148 is open, and the lower end 154 of the cyclone wall includes lower wall 156. The cyclone wall 148 is positioned in the filtration member housing 120 such that it is spaced from the sidewall 130, top wall 132, and bottom wall 134 of the filtration member housing 120. A plurality of struts 158 may be provided to support the cyclone wall 148 within the filtration member housing 120. The space between the lower wall 156 of the cyclone 144 and the bottom wall 134 of the filtration member housing 122 forms a lower end of dirt collection chamber 160.

The cyclone 144 further includes a cyclone air inlet 162, and a cyclone air outlet 164. The cyclone air inlet 162 extends from a first end (not shown) that is in communication with the hose 117, through the sidewall 130 of the filtration member housing 120, to a second end (not shown) that is in communication with the cyclone chamber 150. The cyclone air outlet 164 extends along the axis 146, from a first end 170 that is positioned within the cyclone chamber 150, through the lower wall 156, and to a second end 172 that is in communication with the interior of the suction motor housing 122. A screen (not shown) is preferably mounted over the first end 170 of the cyclone air outlet.

In use, air flows from the hose 117 into the cyclone chamber 150 through the cyclone air inlet 162. In the cyclone chamber 150, the air flows within the cyclone wall 148 in a cyclonic pattern, and particulate matter is separated from the air. The particulate matter exits the cyclone chamber 150 through the first end 152, and settles in the dirt collection chamber 160. The air exits the cyclone chamber 150 through the cyclone air outlet 164, and enters the suction motor housing 122.

The dirt collection chamber 160 may be emptied in any suitable manner. In the embodiment shown, the bottom wall 134 is pivotally mounted to the sidewall 130, and serves as an openable door. The dirt collection chamber 160 may be emptied by removing the filtration member housing 120 from the suction motor housing 124, as described hereinabove, and pivoting the bottom wall 134 away from the sidewall 130.

Referring still to FIG. 2, the suction motor housing 122 houses the suction motor 126, a pre-motor filter 176 upstream of the suction motor 126 and downstream of the cyclone 144, and a post-motor filter (not shown) downstream of the suction motor 126 and upstream of the clean air outlet 104 in a post-motor filter region 178.

The pre-motor filter 176 extends across the open top 140 of the suction motor housing 122, and has an upstream side 180 that faces the cyclone air outlet 164, and an opposed downstream side 182 that faces the bottom wall 138 of the suction motor housing 122. The pre-motor filter 176 is supported within the suction motor housing 122 on apertured support wall 184. As exemplified, apertured support wall 184 comprises motor housing plate 187 which is provided with support members, e.g., a plurality of spaced apart support ribs 185. The pre-motor filter 176 is supported on the top surfaces of the plurality of spaced apart support ribs 185 (seen most clearly in FIG. 3), which extend away from a motor housing plate 187. Supporting the pre-motor filter 176 on the ribs 185 defines an air plenum 189 between the pre-motor filter 176 and the motor housing plate 187.

The pre-motor filter 176 is sized to be generally snugly received within the suction motor housing 122, such that air entering the suction motor housing 122 from the cyclone air outlet 164 passes through the pre-motor filter 176, in a direction indicated by arrow A. The pre-motor filter 176 may be any suitable type of filter. Preferably, the pre-motor filter includes a foam layer 186 and a felt layer 188.

Figure 4:
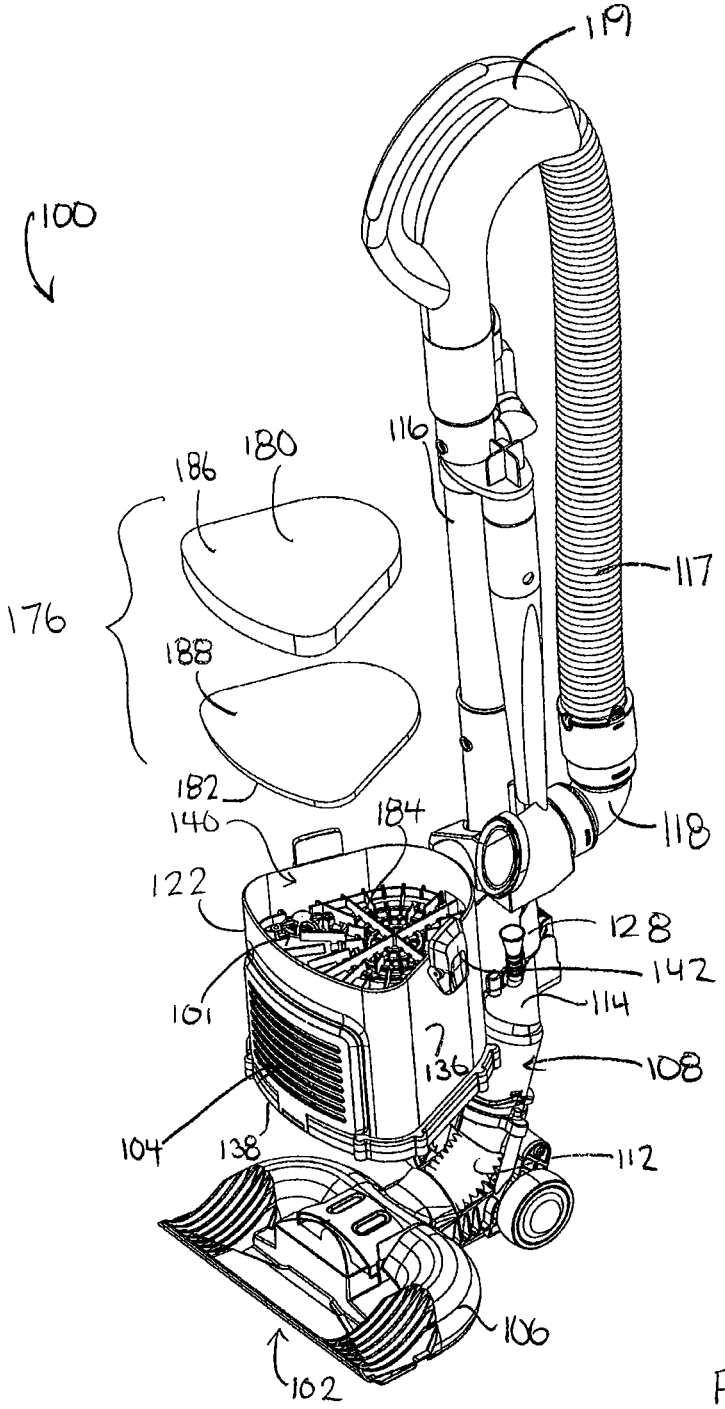
FIG. 4 is a top perspective illustration of the surface cleaning apparatus of FIG. 1, with a filtration member housing removed, and a pre-motor filter exploded from the suction motor housing.

Referring to FIG. 4, when the filtration member housing 120 is lifted off of the suction motor housing 122, the pre-motor filter 176 is exposed, and may be removed, replaced, or cleaned.

It will also be appreciated that, by configuring the surface cleaning apparatus such that the upstream side of the pre-motor filter is visible when the cyclone is emptied, that a user will be provided with a visual cue to clean or replace the pre-motor filter if the upstream side of the pre-motor filter is dirty when the cyclone is removed for emptying. Preferably, the pre-motor filter is not provided in a filter housing so the view of the upstream surface of the pre-motor filter is not impaired.

Referring back to FIG. 2, the suction motor 126 is housed within the suction motor housing 122 beneath the apertured support wall 184. The suction motor 126 may be any suitable type of suction motor. In the embodiment shown, the suction motor 126 extends along a longitudinal axis 190 that is generally vertically extending.

The post motor filter 178 is housed within the suction motor housing 122 adjacent the suction motor 126, and between the suction motor 126 and the clean air outlet 104. Preferably, a second apertured wall 192 is provided between the suction motor 126 and the post-motor filter 178. The post-motor filter 178 may be any suitable type of filter, such as a HEPA filter.

It will be appreciated that the various elements discussed herein are for reference for the discussion of the specific exemplified embodiments and that the elements such as the cleaning head, the cyclone, the upper section and the like may be of various constructions known in the art. It will also be appreciated that some elements that are discussed are optional and need not be in any particular embodiment.

It is possible that in some instances, the airflow passage may become fully or partially clogged. For example, a large object, such as a ball of hair or popcorn, may become lodged anywhere in the airflow passage, such as in the surface cleaning head 106. For further example, the pre-motor filter 176 may become clogged with particulate matter. If this occurs, the suction motor 126 may burn out. Referring still to FIG. 2, a bleed-valve 101 is provided in the suction motor housing 122. If a clog occurs in the airflow passage, the pressure in the suction motor housing 122 will decrease. The bleed valve 101 is preferably configured to open when the pressure decreases, and allow air to flow through the suction motor housing 122 to the clean air outlet 104 so that the suction motor 126 does not burn out.

Figure 3:
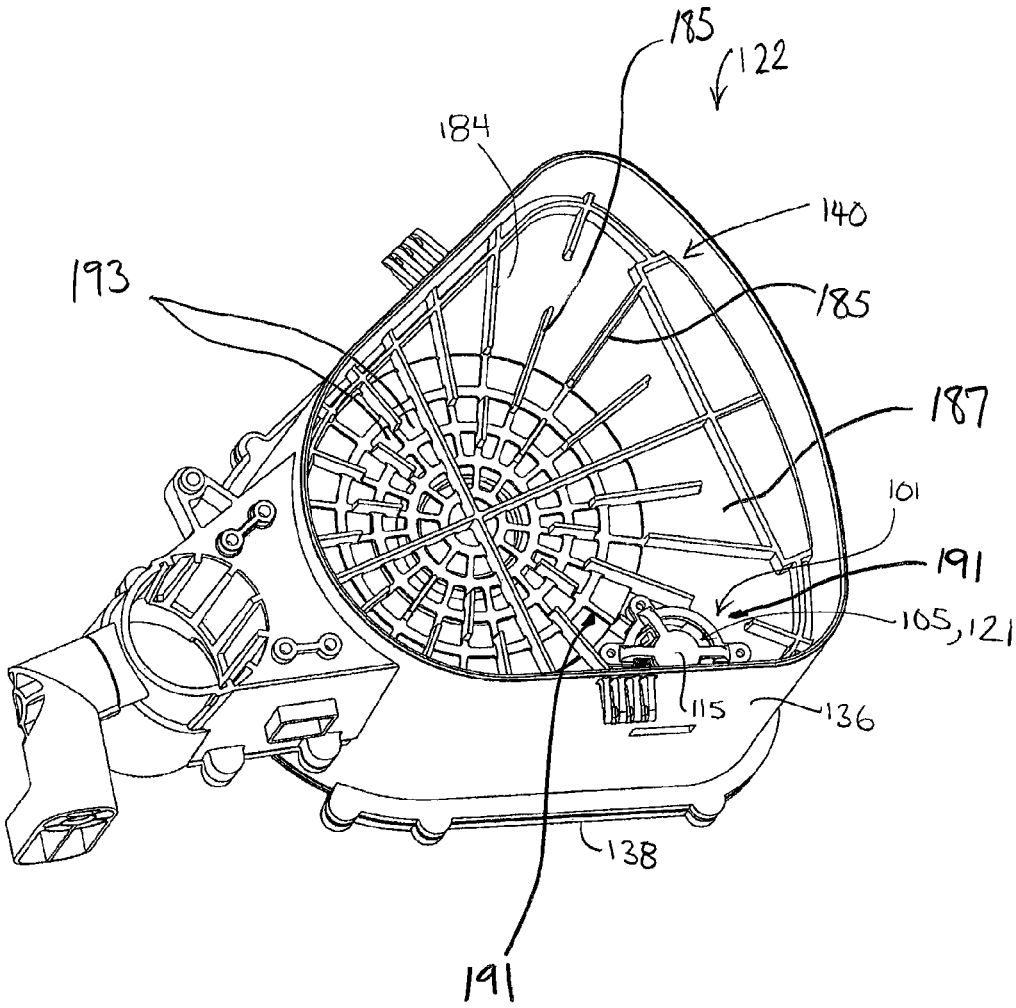
FIG. 3 is a top perspective illustration of a suction motor housing of the surface cleaning apparatus of FIG. 1.

Referring to FIGS. 2 and 3, the spacing between the ribs 185 is preferably selected so that the pre-motor filter 176 is supported above the motor housing plate 187 when the airflow passage upstream of the downstream side of the pre-motor filter 176 is clogged, without the pre-motor filter 176 collapsing against the plate 187 between the ribs 185 (i.e. the plenum 189 is maintained). Air received in the plenum 189 (from the pre-motor filter 176 or the bleed valve 101) can circulate within the plenum 189, through a plurality of optional gaps 191 provided in the ribs 185, before ultimately flowing through apertures 193 in the motor housing plate 187 and into the suction motor 126.

Preferably, at least some of the support members are configured such that air entering the bleed air flow path through the bleed valve travels other than radially inwards towards the inlet of the suction motor. For example, gaps 191 will permit air entering plenum 289 through the bleed valve to travel laterally and be distributed across part or all of motor housing plate 187 so that plenum 189 defines a generally continuous airspace between the pre-motor filter 176 and the motor housing plate 187. Accordingly, plenum 189 may provide a bleed air flow path between the bleed valve outlet 105 and the suction motor 126 that does not pass through the pre-motor filter 176 in any condition of operation. It will be appreciated that ribs 185 may be of various designs. As exemplified, ribs 185 may be relatively straight wherein some or all have a gap or cutout 191. The gaps of cutouts may extend all the way to motor housing plate 187 so that each rib 185 comprises a plurality of discrete rib elements which, taken together, define a single rib 185. Alternately, other support members may be used, such as a plurality of discrete support posts that extends upwardly from motor housing plate 187. The ribs preferably have a narrow top end abutting the pre-motor filter 176. However, the top surfaces maybe wider.

Referring still to FIG. 2, the bleed valve 101 includes an air inlet 103, and air outlet 105, and a longitudinally extending airflow passageway 107 extending therebetween. The air inlet 103 is preferably formed through the sidewall 136 of the suction motor housing 122, and is preferably at angle to the airflow passageway 107. The air outlet 105 is formed through the apertured support wall 184, and is positioned between the suction motor 126 and the downstream side 182 of the pre-motor filter 176. Preferably, as shown, the air outlet 105 faces the downstream side 182 of the pre-motor filter 176. More preferably, the air outlet 105 additionally faces the cyclone air outlet 164.

The airflow passageway 107 is defined by a sidewall 109 extending between the sidewall 136 of the suction motor housing 122 and the apertured support wall 184. The sidewall 109 is preferably integral with the suction motor housing 122 (in other words, the bleed valve 101 is integrally formed with the suction motor housing 122). The airflow passageway 107 extends along a longitudinal axis 111. As shown, the longitudinal axis 111 is preferably parallel with the longitudinal axis 146 of the cyclone 144 and the cyclone air outlet 164, and is preferably aligned with the longitudinal axis 190 of the suction motor 126. Further, the airflow passageway 107 is preferably aligned with a direction of flow (as shown by arrow A) through the pre-motor filter 176. It will be appreciated that, in an alternate embodiment, passageway 107 may extend all the way to wall 138 so that the inlet 103 is in wall 138.

Alternatively, instead of being parallel to the longitudinal axis 146, the bleed valve 101 may be positioned in a transverse configuration, in which the longitudinal axis 111 is generally orthogonal to the axis 146. In this configuration, the at least a portion of the sidewall 109 and air outlet 105 of the bleed valve 101 can be positioned within the plenum 189, below the upper surfaces of the ribs 185 supporting the pre-motor filter 176. Optionally, at least a portion of the bleed valve sidewall 109 can be integral with the motor housing plate 187. If the transverse bleed valve is configured such that the bleed valve sidewall is spaced apart from the pre-motor filter, one or more support ribs extending between the bleed valve sidewall and the pre-motor filter can be provided. In this configuration, air exiting the bleed valve 101 is generally orthogonal to the direction of the air flow entering the suction motor 126. Preferably, the gaps 191 in the support ribs 185 are configured to receive air exiting the bleed valve 101 and to distribute the incoming air within the plenum 189.

The bleed valve 101 may be opened and closed in any suitable manner, and is preferably opened automatically when the pressure in the suction motor housing 122 decreases. In the embodiment shown, the bleed valve 101 includes an actuating member 113. The actuating member 113 includes a cap 115, which is mounted to the apertured support wall 184 over the air outlet 105 of the bleed valve 101. The cap 115 has apertures 121 therethrough, to allow air to flow out of the air outlet 105. A bearing member 123 is suspended from the cap 115 by a spring 125. The bearing member 123 includes a lower plate 127 that has a diameter that is slightly less than the diameter of the portion of the airflow passage 107 adjacent the lower plate 127. The sidewall 109 of the airflow passage includes a shelf 129, and a seal 131 is seated on and secured to the shelf 129, facing the lower plate 127. During normal use of the surface cleaning apparatus, the spring 125 forces the lower plate 127 against the seal 131, so that air cannot flow between the lower plate 127 and the seal 127, and cannot flow through the airflow passage 107. When the pressure in the suction motor housing 122 decreases enough to overcome the spring force of the spring 125, the lower plate 127 will lift away from the seal 131, so that air may flow laterally between the lower plate 127 and the seal 131, and upwardly between the lower plate 127 and the sidewall 109.

Referring to FIG. 3, when the pre-motor filter 176 is removed from the suction motor housing 122, the air outlet 105 of the bleed valve 101 is preferably visible.

Figure 5:
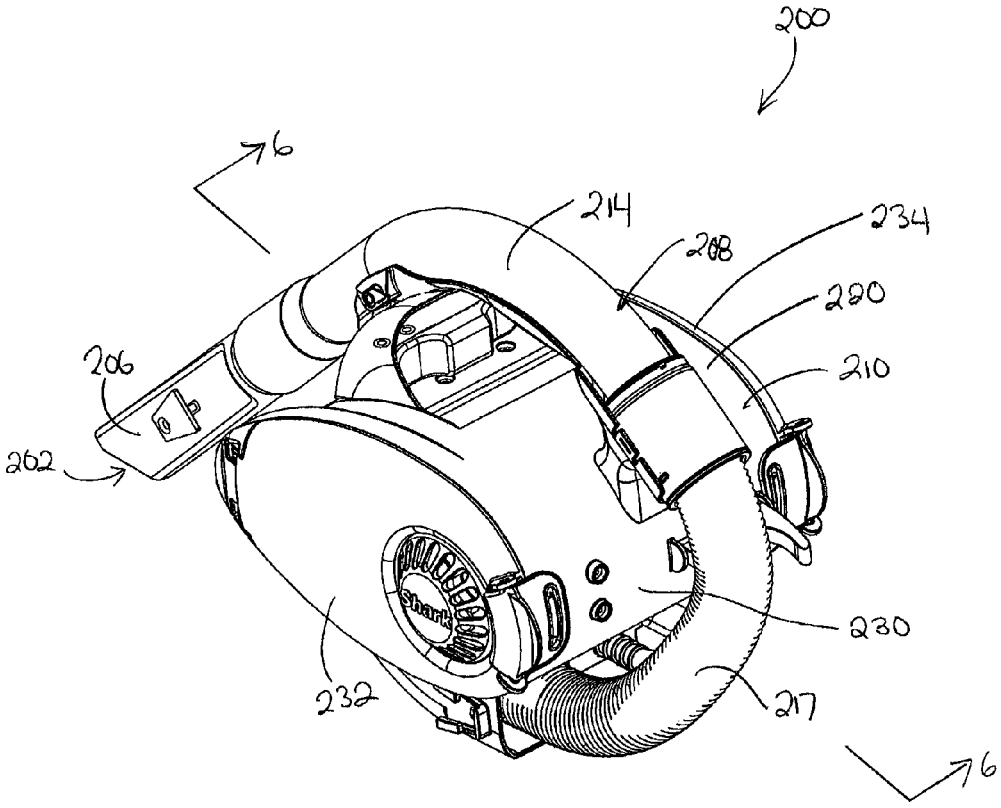
FIG. 5 is a perspective illustration of another embodiment of a surface cleaning apparatus.
Figure 6:
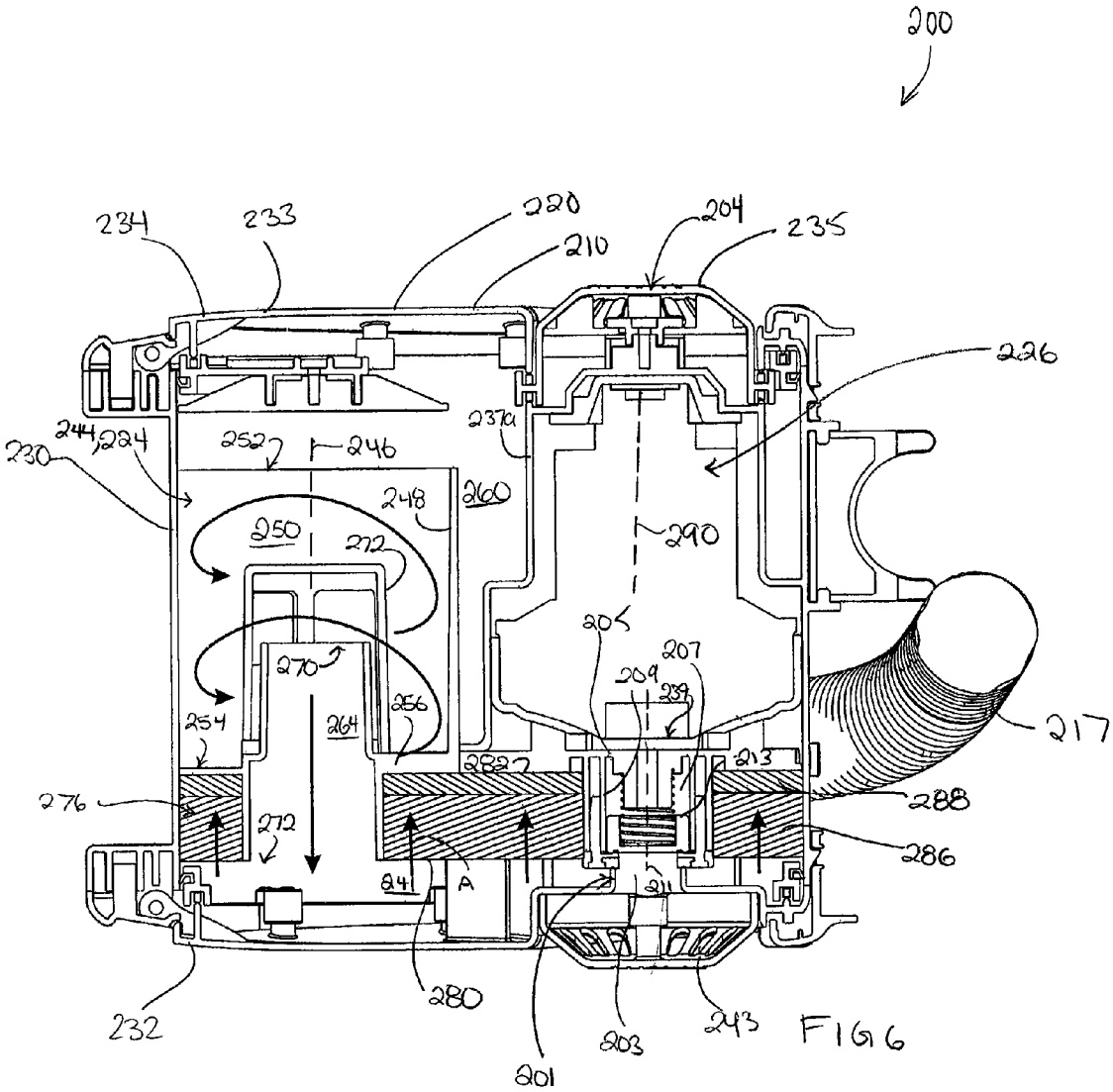
FIG. 6 is a cross section taken along line 6-6 in FIG. 5.
Figure 7:
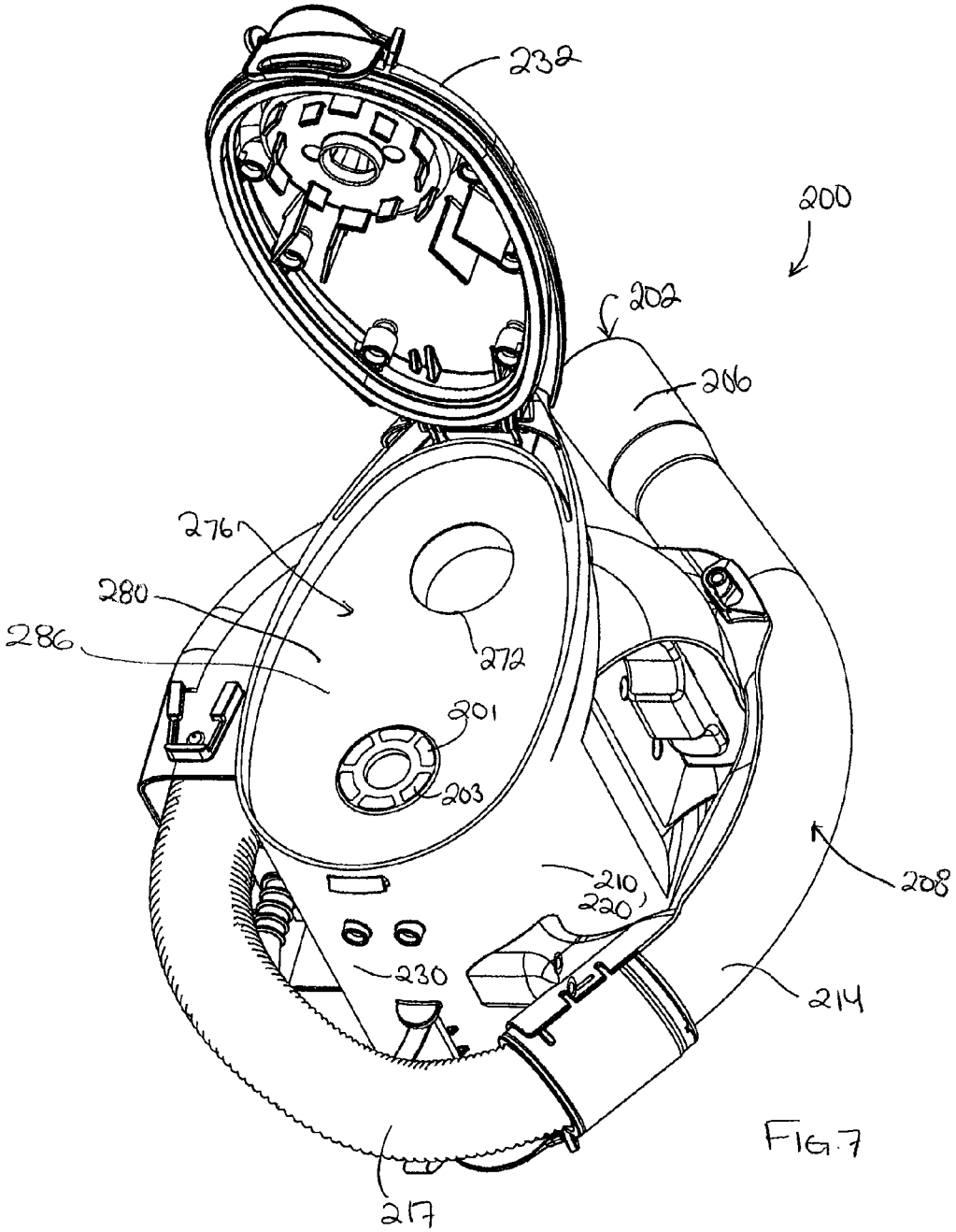
FIG. 7 is a perspective illustration of the surface cleaning apparatus of FIG. 5, showing an openable door in an open position.

Referring to FIGS. 5 to 7, another embodiment of a surface cleaning apparatus 200 is shown. In this embodiment the surface cleaning apparatus 200 is a hand vacuum cleaner.

Referring to FIG. 5, the surface cleaning apparatus 200 has a dirty air inlet 202, a clean air outlet 204 (shown in FIG. 6), and an air flow passage extending therebetween. In the embodiment shown, the dirty air inlet 202 is provided in a nozzle 206. From the dirty air inlet 202, the airflow passage extends through the nozzle 206, and through an air conduit 208, to a suction and filtration unit 210. The clean air outlet 204 is provided in the suction and filtration unit 110. In the embodiment shown, the air conduit 108 includes a wand 214, and a hose 217.

Referring now to FIGS. 5 and 6, the suction and filtration unit 210 includes a housing 220. The housing 220 houses a filtration member 224, which is positioned in the airflow passage downstream of the dirty air inlet 202, for removing particulate matter from air flowing through the airflow passage. The housing 220 further houses a suction motor 226, which is provided in the airflow passage downstream of the filtration member 224 for drawing air through the airflow passage. In the embodiment shown, the filtration member 224 and suction motor 226 are positioned side-by-side.

Referring to FIG. 5, in the embodiment shown, the housing 220 includes a central wall 230, a first side wall 232, and a second side wall 234. The first side wall 232 is pivotally mounted to the central wall 230, and serves as an openable door. The second sidewall 234 has a first portion 233 adjacent the filtration member 224, and a second portion 235 adjacent the suction motor 226. The first portion is pivotally mounted to the central wall 230. The second portion 235 is removable from the central wall 230 when the first portion 233 is open. A plurality of interior walls, including a central interior wall 237, extend within the housing 220, to separate the suction motor 226 from the filtration member 224, so that fluid communication between the filtration member 224 and the suction motor 226 may generally only occur between a filtration member air outlet 264, and a suction motor air inlet 239, as will be described in further detail hereinbelow.

Referring to FIG. 6, in the embodiment shown, the filtration member 224 is a cyclone 244. In alternate embodiments, the filtration member 224 may be, for example, a filter, such as a filter bag or a foam filter. In further alternate embodiments, the filtration member 224 may include a plurality of cyclones, or a plurality of cyclonic stages.

The cyclone 244 may be of any suitable configuration. In the embodiment shown, the cyclone 244 extends along a longitudinal axis 246, which is generally horizontally extending. The cyclone 244 includes a cyclone wall 248, which is integral with the central wall 230, and together with the central wall 230 defines a cyclone chamber 250. A first end 252 of the cyclone wall 148, which is positioned towards the second sidewall 234, is open, and an opposed second end 254 of the cyclone wall includes a second end wall 256. The cyclone wall 248 is positioned in the housing 220 such that it is spaced from the second sidewall 234. The central interior wall 237 is integral with the cyclone wall 248, and extends away from the cyclone wall 248, and along the cyclone wall 248, towards the second sidewall 234. The space between the first end 252 of the cyclone wall 248, the first portion 233 of the second sidewall 234, and the central interior wall 237 forms a dirt collection chamber 260.

The cyclone 244 further includes a cyclone air inlet (not shown), and a cyclone air outlet 264. The cyclone air inlet extends from a first end that is in communication with the hose 217 through the central wall 230 of the filtration member housing 220, to a second end that is in communication with the cyclone chamber 250. The cyclone air outlet 264 extends along the axis 246, from a first end 270 that is positioned within the cyclone chamber 250, through the lower wall 156, and to a second end 272 (also referred to herein as an outlet 272 of the cyclone air outlet 264) that is in communication with a chamber 241 adjacent the first sidewall 232 of the suction and filtration unit 210. A screen 272 is preferably mounted over the first end 270 of the cyclone air outlet.

In use, air flows from the hose 217 into the cyclone chamber 250 through the cyclone air inlet. In the cyclone chamber 250, the air flows within the cyclone wall 248 in a cyclonic pattern, and particulate matter is separated from the air. The particulate matter exits the cyclone chamber 250 through the first end 152, and settles in the dirt collection chamber 260. The air exits the cyclone chamber 250 through the cyclone air outlet 264, and enters the chamber 241

The dirt collection chamber 260 may be emptied in any suitable manner. In the embodiment shown, the first portion 233 of the second side wall 234 is pivotally openable, so that the dirt collection chamber 260 may be opened.

Referring still to FIG. 6, the surface cleaning apparatus includes a pre-motor filter 276. The pre-motor filter 276 is housed in the chamber 241, and is snugly received within the central wall 230. The pre-motor filter has an upstream side 280 that faces the first sidewall 232 of the housing 220, and an opposed downstream side 282 that faces the second sidewall 234 of the housing 220. The pre-motor filter 276 may be any suitable type of filter. Preferably, the pre-motor filter includes a foam layer 286 and a felt layer 288.

Referring still to FIG. 6, the cyclone air outlet 264 extends through the pre-motor filter 276, so that air exiting the pre-motor filter 276 is in contact with the upstream side 280 of the pre-motor filter 286.

The air then passes through the pre-motor filter 276, towards a suction motor inlet 239 that faces the downstream side 282 of the pre-motor filter 276. From the suction motor inlet 239, the air passes towards and out of the clean air outlet 204.

Once again, it will be appreciated that the various elements discussed herein are for reference for the discussion of the specific exemplified embodiments and that the elements such as the air flow path upstream of the cyclone, the cyclone, the suction motor and the like may be of various constructions known in the art. It will also be appreciated that some elements that are discussed are optional and need not be in any particular embodiment.

Referring still to FIG. 6, the surface cleaning apparatus further includes a bleed valve 201. As described hereinabove with respect to the surface cleaning apparatus 100, the bleed valve 201 allows air to flow from the suction motor inlet 239 to the clean air outlet 204 so that the suction motor 226 does not burn out if a clog occurs.

Referring still to FIG. 6, the bleed valve 201 extends through the pre-motor filter 276. Specifically, the bleed valve 201 includes an air inlet 203, and air outlet 205, and a longitudinally extending airflow passageway 207 extending therebetween. The air inlet 203 is preferably formed through the first side wall 232 of the housing 220, and is adjacent the upstream side 280 of the pre-motor filter 276. A grate 243 is preferably provided over the air inlet 203. The airflow passageway 207 is defined by a sidewall 209 extending through the pre-motor filter 276. The air outlet 205 is defined by an open end of the airflow passageway 207, and is adjacent the downstream side 282 of the pre-motor filter 276. The air outlet 205 faces and is in communication with the motor inlet 239.

The airflow passageway 207 extends along a longitudinal axis 211. As shown, the longitudinal axis 211 is preferably parallel with the longitudinal axis 246 of the cyclone 244 and the cyclone air outlet 264, and is preferably aligned with a longitudinal axis 290 of the suction motor 226. Further, the airflow passageway 207 is preferably aligned with a direction of flow (as shown by arrow A) through the pre-motor filter 176.

The bleed valve 201 may be opened and closed in any suitable manner, and is preferably opened automatically when the pressure at the suction motor 226 decreases. In the embodiment shown, the bleed valve 201 includes an actuating member 213 that maybe similar to the actuating member 113 described hereinabove, and will not be described in detail herein, although it will be appreciated that various mechanisms may be utilized in any embodiment.

As mentioned hereinabove the first sidewall 232 is pivotally mounted to the central wall 230, and serves as an openable door. Referring to FIG. 7, the first sidewall 232 is openable to provide access to the pre-motor filter 276, so that it may be, for example, removed, replaced, or cleaned. In alternate embodiments, the surface cleaning apparatus 200 may alternately or additionally be configured such that the first sidewall 232 may be openable to provide access to the dirt collection chamber 260.

Figure 8:
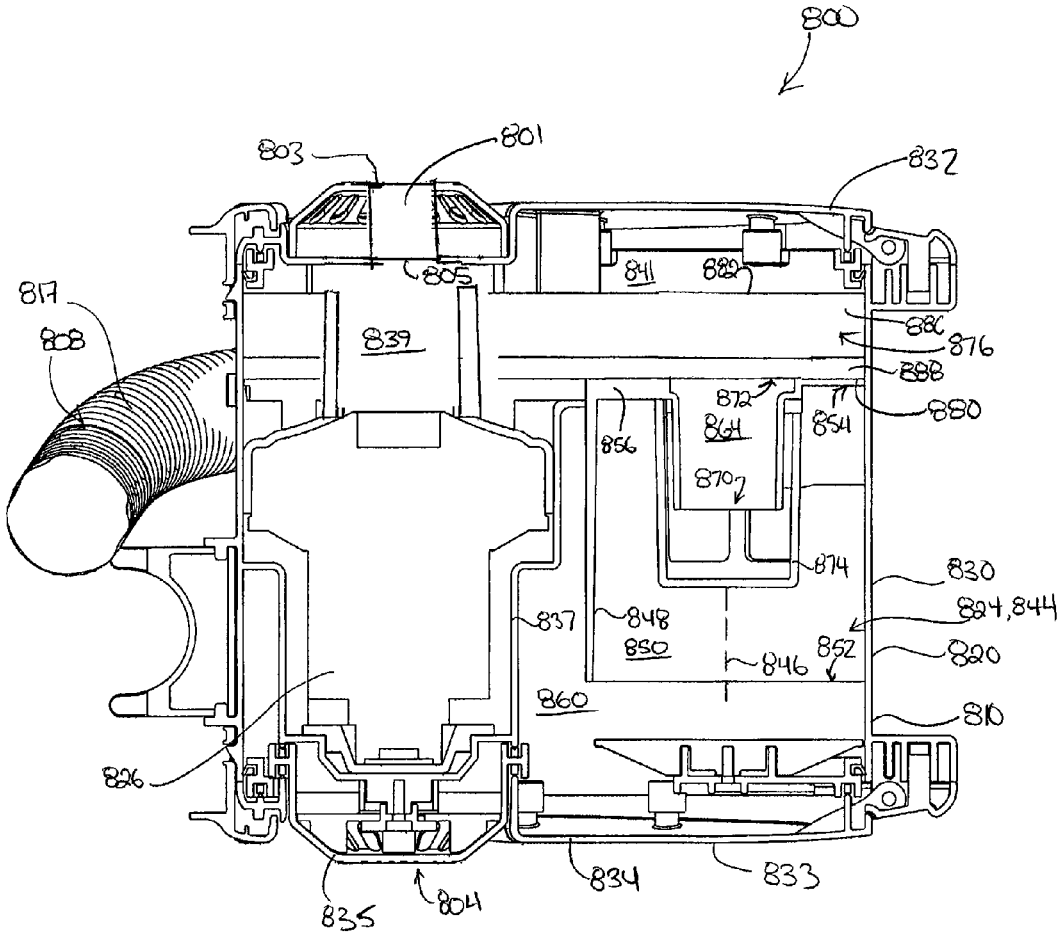
FIG. 8 is a cross section showing another embodiment of a surface cleaning apparatus.

Referring to FIG. 8, a further alternate surface cleaning apparatus 800 is shown. The surface cleaning apparatus is similar to the surface cleaning apparatus 500, and like numerals in the surface cleaning apparatus 800 will be used to describe like features as in the surface cleaning apparatus 500, with the first digit incremented to 8.

In the surface cleaning apparatus 800, the cyclone air outlet 864 does not extend through the pre-motor filter 876. The upstream side 280 of the pre-motor filter 876 faces towards the second sidewall 834 of the housing 820, and the downstream side 882 of the pre-motor filter 876 faces the first sidewall 834. Air passes out of the second end 872 of the cyclone air outlet 864, through the pre-motor filter, and into the chamber 841.

The suction motor 826 has a suction motor inlet that extends through the pre-motor filter 876, so that it is in communication with the downstream side 882 of the pre-motor filter 876.

In this embodiment, the bleed valve 801 is provided in the openable door, and has an air outlet 805 that is within the chamber 841, so that it is in communication with the suction motor air inlet 239.

When the openable door is open, the suction motor inlet 839 is visible, and the downstream side 882 of the pre-motor filter 876 is visible.

Figure 9:
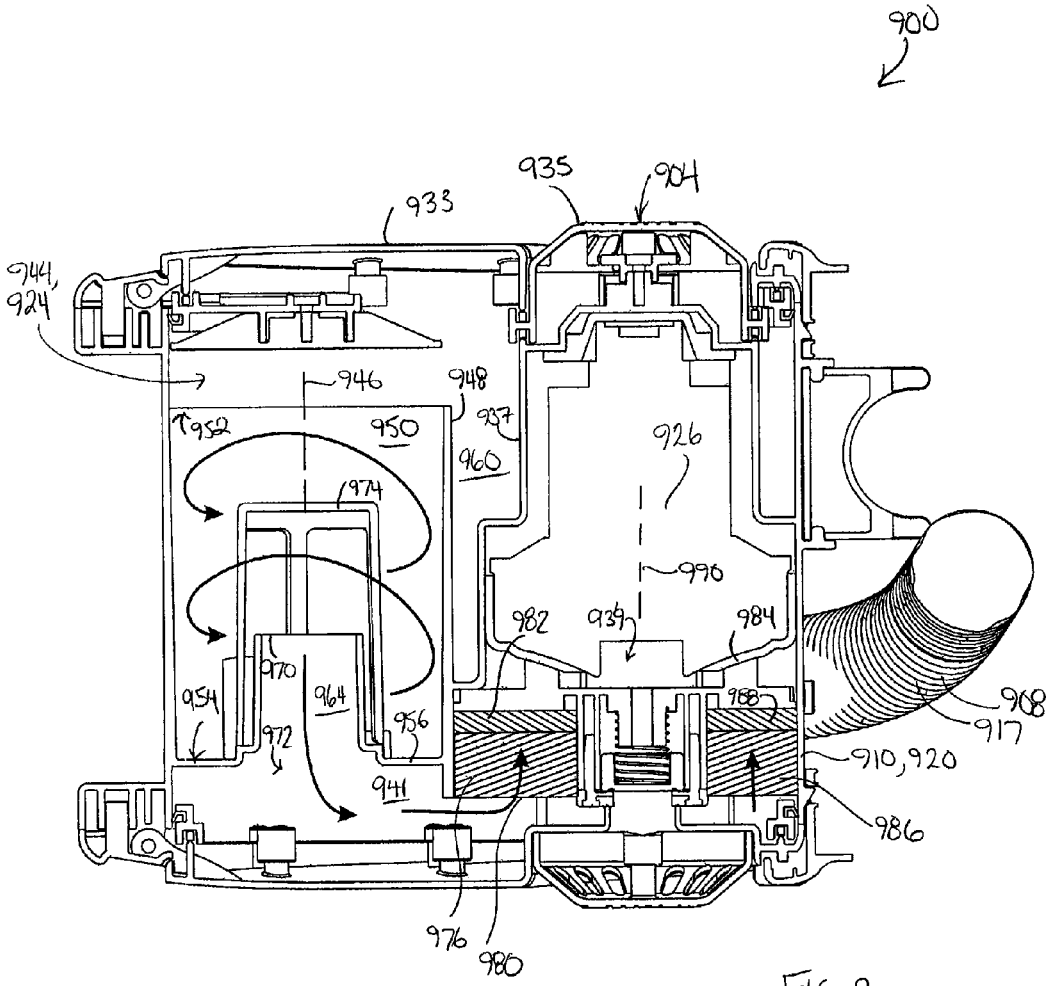
FIG. 9 is a cross section showing another embodiment of a surface cleaning apparatus.
Figure 10:
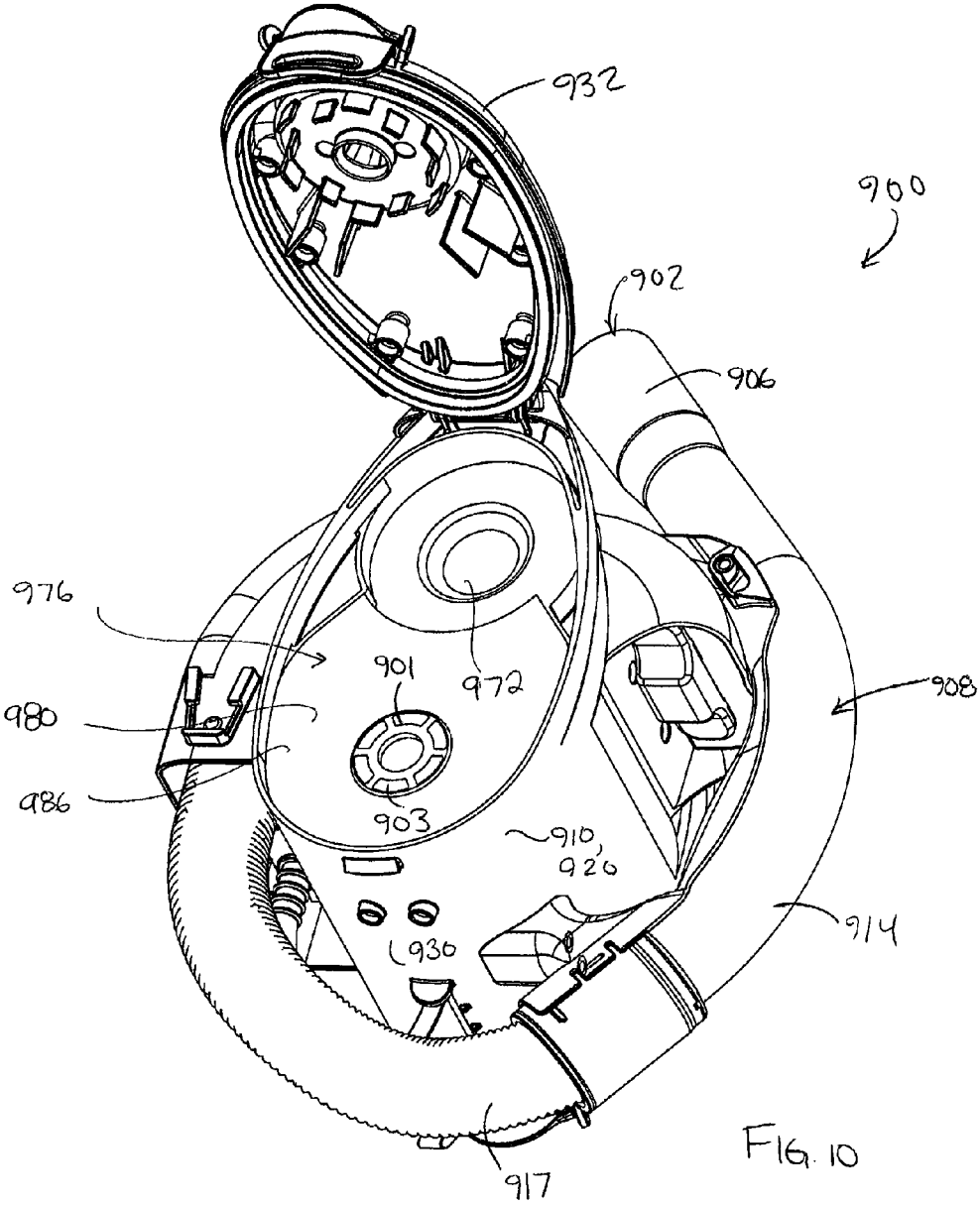
FIG. 10 is a perspective illustration of the surface cleaning apparatus of FIG. 9, showing an openable door in an open position.

Referring to FIGS. 9 and 10, a further alternate surface cleaning apparatus 900 is shown. The surface cleaning apparatus is similar to the surface cleaning apparatus 500, and like numerals in the surface cleaning apparatus 900 will be used to describe like features as in the surface cleaning apparatus 500, with the first digit incremented to 9.

In this embodiment, the pre-motor filter 976 extends only across the suction motor 226. The cyclone air outlet 974 is in communication with the chamber 941. The upstream side 980 of the pre-motor filter the first sidewall 932 of the housing 920, and an opposed downstream side 982 that faces the second sidewall 934 of the housing 220.

The air passes through the pre-motor filter 976, towards the suction motor inlet 939 that is facing the downstream side 982 of the pre-motor filter 976. From the suction motor inlet 939, the air passes towards and out of the clean air outlet 904.

Referring still to FIG. 9, the surface cleaning apparatus further includes a bleed valve 901. As described hereinabove with respect to the surface cleaning apparatus 500, bleed valve 901 extends through the pre-motor filter 976.

Referring to FIG. 10, when the openable door is open, the upstream side 980 of the pre-motor filter 976 is visible.

It will be appreciated that by positioning the bleed valve in line with the air flow direction, that the size of the outer housing of the surface cleaning apparatus may be reduced. This is particularly preferred for hand operable surface cleaning apparatus. As exemplified herein, part or all of a bleed valve may itself be placed in the pre-motor filter. Accordingly, by utilizing space otherwise occupied by the pre-motor filter, then size of the surface cleaning apparatus may be reduced. As exemplified in the embodiment of FIGS. 6 and 8, the pre-motor filter may extend over a portion or all of the cyclone. Accordingly, the surface area of the pre-motor filter exposed to the air flow may be increased. Therefore, even if the bleed valve is placed in the pre-motor filter, the capacity of the pre-motor filter need not be impaired.

It will also be appreciated that, by configuring the surface cleaning apparatus such that the upstream side of the pre-motor filter is visible when a filter door is opened, that a user will be provided with a visual cue to clean or replace the pre-motor filter if the upstream side of the pre-motor filter is dirty when the door is opened.

Various apparatuses or methods are described above to provide an example of each claimed invention. No example described above limits any claimed invention and any claimed invention may cover processes or apparatuses that are not described above. The claimed inventions are not limited to apparatuses or processes having all of the features of any one apparatus or process described above or to features common to multiple or all of the apparatuses described above.

The invention claimed is:

1. A surface cleaning apparatus comprising:

(a) an air flow passage extending from a dirty air inlet to a clean air outlet;

(b) a cyclone comprising a cyclone air outlet and positioned in the air flow passage downstream of the dirty air inlet;

(c) a suction motor provided in the air flow passage downstream of the cyclone;

(d) a pre-motor filter upstream of the suction motor and downstream of the cyclone, the pre-motor filter having an upstream side and a downstream side; and, (e) a bleed valve having an air inlet, an airflow passageway having a longitudinal axis and an air outlet, the air outlet positioned between the suction motor and the downstream side of the pre-motor filter and the longitudinal axis intersecting the downstream side of the pre-motor filter.

2. The surface cleaning apparatus of claim 1 wherein the cyclone has a longitudinal axis, the bleed valve comprises an airflow passageway having a longitudinal axis, and the longitudinal axes are parallel.

3. The surface cleaning apparatus of claim 1 wherein the air outlet of the bleed valve faces the cyclone air outlet.

4. The surface cleaning apparatus of claim 1 wherein the bleed valve is integrally formed with a suction motor housing.

5. The surface cleaning apparatus of claim 1 wherein the bleed valve is provided in a suction motor housing and has a longitudinally extending passageway that is aligned with a longitudinal axis of the suction motor.

6. The surface cleaning apparatus of claim 1 wherein the bleed valve has a longitudinally extending passageway that is aligned with a longitudinal axis of the suction motor.

7. The surface cleaning apparatus of claim 6 wherein the air inlet of the bleed valve is at an angle to the longitudinally extending passageway of the bleed valve.

8. The surface cleaning apparatus of claim 7 wherein the bleed valve is integrally formed with a suction motor housing and the air inlet of the bleed valve is provided in a sidewall of the suction motor housing.

9. The surface cleaning apparatus of claim 1 wherein the pre-motor filter is removable and the air outlet of the bleed valve is visible when the pre-motor filter is removed.

10. The surface cleaning apparatus of claim 1 wherein the bleed valve has a longitudinally extending passageway that is aligned with a longitudinal axis of the suction motor and a direction of flow through the pre-motor filter.

11. The surface cleaning apparatus of claim 1 further comprising an openable door and the bleed valve is provided in the openable door.

12. The surface cleaning apparatus of claim 11 wherein the openable door provides access to at least one of the pre-motor filter and a dirt collection chamber of the cyclone.

13. The surface cleaning apparatus of claim 1 wherein the bleed valve extends through the pre-motor filter.

14. The surface cleaning apparatus of claim 1, wherein the pre-motor filter rests on a plurality of support members whereby the pre-motor filter is spaced from an inlet of the suction motor and a bleed air flow path is provided between the downstream side of the pre-motor filter and the inlet of the suction motor.

15. The surface cleaning apparatus of claim 14, wherein at least some of the support members are configured such that air entering the bleed air flow path through the bleed valve travels other than radially inwards towards the inlet of the suction motor.

16. The surface cleaning apparatus of claim 14, wherein the support members are provided on a housing for the suction motor.

17. The surface cleaning apparatus of claim 14 wherein the filtration member has a filtration member air outlet extending along a longitudinal axis, the bleed valve comprises an airflow passageway having a longitudinal axis, and the longitudinal axes are parallel.

18. The surface cleaning apparatus of claim 1 further comprising a valve member positioned in the airflow passageway.

19. The surface cleaning apparatus of claim 18 wherein the valve member is moveably mounted along the longitudinal axis between an open and a closed position.

20. A surface cleaning apparatus comprising:

(a) an air flow passage extending from a dirty air inlet to a clean air outlet;

(b) a filtration member positioned in the air flow passage downstream of the dirty air inlet;

(c) a suction motor provided in the fluid flow path downstream of the filtration member;

(d) a pre-motor filter upstream of the suction motor and downstream of the filtration member, the pre-motor filter having an upstream side and a downstream side; and, (e) a bleed valve provided in the suction motor housing and having an air inlet, an air outlet and a longitudinally extending passageway that extends generally parallel to the longitudinal motor axis, the air outlet positioned between the suction motor and the downstream side of the pre-motor filter and the bleed valve configured so that air travels through the longitudinally extending passageway in a first direction and travels through the air inlet in a different, second direction.

21. The surface cleaning apparatus of claim 20 wherein the filtration member comprises a cyclone having a cyclone air outlet and the bleed valve outlet faces towards the cyclone air outlet.

22. The surface cleaning apparatus of claim 20 wherein the air outlet of the bleed valve faces the downstream side of the pre-motor filter.

23. The surface cleaning apparatus of claim 20 wherein the bleed valve is integrally formed with a suction motor housing.

24. The surface cleaning apparatus of claim 20 wherein the bleed valve is integrally formed with a suction motor housing and the air inlet of the bleed valve is provided in a sidewall of the suction motor housing.

25. The surface cleaning apparatus of claim 20 wherein the pre-motor filter is removable and the air outlet of the bleed valve is visible when the pre-motor filter is removed.

26. The surface cleaning apparatus of claim 20 wherein the bleed valve has a longitudinally extending passageway that is aligned with a longitudinal axis of the suction motor.

27. The surface cleaning apparatus of claim 20 wherein the bleed valve has a longitudinally extending passageway that is aligned with a longitudinal axis of the suction motor and a direction of air flow through the pre-motor filter.

28. The surface cleaning apparatus of claim 20 further comprising an openable door and the bleed valve is provided in the openable door.

29. The surface cleaning apparatus of claim 28 wherein the openable door provides access to at least one of the pre-motor filter and a dirt collection chamber.

30. The surface cleaning apparatus of claim 20 wherein the filtration member comprises a cyclone and the pre-motor filter comprises foam.

31. The surface cleaning apparatus of claim 20 wherein the bleed valve extends through the pre-motor filter.

32. The surface cleaning apparatus of claim 20 wherein the filtration member comprises a cyclone having a cyclone air outlet that has an outlet on the upstream side of the pre-motor filter, the surface cleaning apparatus further comprises an openable door, and the bleed valve is provided in the openable door and extends through the pre-motor filter.

33. The surface cleaning apparatus of claim 32 wherein the cyclone outlet extends through the pre-motor filter.

34. The surface cleaning apparatus of claim 20, wherein the pre-motor filter rests on a plurality of support members whereby the pre-motor filter is spaced from an inlet of the suction motor and a bleed air flow path is provided between the downstream side of the pre-motor filter and the inlet of the suction motor.

35. The surface cleaning apparatus of claim 34, wherein at least some of the support members are configured such that air entering the bleed air flow path through the bleed valve travels other than radially inwards towards the inlet of the suction motor.

36. The surface cleaning apparatus of claim 20, wherein the support members are provided on a housing for the suction motor.

37. A surface cleaning apparatus comprising:

(a) an air flow passage extending from a dirty air inlet to a clean air outlet;

(b) a cyclone positioned in the air flow passage downstream of the dirty air inlet;

(c) a suction motor provided in the air flow passage downstream of the cyclone and having a longitudinal axis;

(d) a pre-motor filter provided in the air flow passage upstream from the suction motor; and, (e) a bleed valve comprises an airflow passageway having a longitudinal axis, and the longitudinal axis of the bleed valve is parallel to and spaced apart from the longitudinal axis of the suction motor, and the longitudinal axis of the bleed valve is parallel to a direction of air flow through the pre-motor filter.

38. The surface cleaning apparatus of claim 37, further comprising a longitudinally extending motor housing and the bleed valve is provided interior of the motor housing and extends parallel thereto.

39. The surface cleaning apparatus of claim 38, wherein the bleed valve has an inlet end and the motor housing has a bleed air inlet passage that extends inwardly to the inlet end of the bleed valve.

40. The surface cleaning apparatus of claim 37 wherein the pre-motor filter has an upstream side and a downstream side and the bleed valve has an air outlet that faces the downstream side of the pre-motor filter.

41. The surface cleaning apparatus of claim 37, wherein the pre-motor filter has a length and a width in a plane transverse to the direction of flow through the filter and a thickness in the direction of flow through the filter and the thickness is less than the length and less than the width.

* * * * *